US012252972B1

(12) United States Patent
Zhang et al.

(10) Patent No.: US 12,252,972 B1
(45) Date of Patent: Mar. 18, 2025

(54) FLUIDIZED COAL MINING METHOD UTILIZING SELF-ENERGY STORAGE OF COAL SEAM

(71) Applicant: China University of Mining and Technology, Xuzhou (CN)

(72) Inventors: Chaolin Zhang, Xuzhou (CN); Enyuan Wang, Xuzhou (CN); Xiaofei Liu, Xuzhou (CN); Zhonghui Li, Xuzhou (CN); Qiaozhen Jiang, Xuzhou (CN); Mingliang Liu, Xuzhou (CN); Peizhong Wang, Xuzhou (CN); Wei Zeng, Xuzhou (CN)

(73) Assignee: China University of Mining and Technology, Xuzhou (CN)

( * ) Notice: Subject to any disclaimer, the term of this patent is extended or adjusted under 35 U.S.C. 154(b) by 0 days.

(21) Appl. No.: 18/933,000

(22) Filed: Oct. 31, 2024

Related U.S. Application Data

(63) Continuation of application No. PCT/CN2024/107587, filed on Jul. 25, 2024.

(30) Foreign Application Priority Data

Sep. 6, 2023 (CN) ..... 202311152056.4

(51) Int. Cl.
*E21B 43/263* (2006.01)
*E21B 43/29* (2006.01)
*E21C 41/18* (2006.01)

(52) U.S. Cl.
CPC ..... *E21B 43/263* (2013.01); *E21B 43/29* (2013.01); *E21C 41/18* (2013.01)

(58) Field of Classification Search
CPC ..... E21B 43/263; E21B 43/29; E21C 41/18
See application file for complete search history.

(56) References Cited

U.S. PATENT DOCUMENTS 3,964,792 A 6/1976 Archibald
2022/0251953 A1 8/2022 He et al.

FOREIGN PATENT DOCUMENTS

CN 101598030 A 12/2009
CN 101975076 A 2/2011
(Continued)

OTHER PUBLICATIONS

Niu Yue, et al., "Fine identification of coal and gas outbursts based on electric potential inversion method ahead of driving face of deep mine," Journal of Mining and Safety Engineering, date of issue: Sep. 15, 2021, vol. 38, No. 05, pp. 988-996. DOI: 10.13545/j.cnki.jmse.2021.0134 Full text. Claims involved: 1-10.
Xie Heping, et al., "Theoretical and technological conception of the fluidization mining for deep coal resources," Journal of China Coal Society, Mar. 2017, vol. 42, No. 03. DOI: 10.13225/j.cnki.jccs.2017.0299 Full text. Claims involved: 1-10.
(Continued)

*Primary Examiner* — Janine M Kreck
(74) *Attorney, Agent, or Firm* — Pilloff Passino & Cosenza LLP; Rachel Pilloff; Sean Passino

(57) ABSTRACT

A fluidized coal mining method utilizing self-energy storage of a coal seam is provided, and includes developing a mine roadway, uncovering coal actively, mining coal in fluidization, and backfilling a goaf. Dynamic phenomenon is induced by uncovering the coal actively, a coal-mining drilling well is established from a ground to the coal seam, and the coal seam is subjected to hydraulic in-situ cutting, and a coal-rock mixture subjected to hydraulic cutting flows into a roadway system along a floor roadway, and then coal, gangue and water in the mixture are separated and recycled in a subsequent circulating coal mining process.

10 Claims, 4 Drawing Sheets

(56) References Cited

FOREIGN PATENT DOCUMENTS

| | | | |
|---|---|---|---|
| CN | 101979835 | A | 2/2011 |
| CN | 102121393 | A | 7/2011 |
| CN | 103510957 | A | 1/2014 |
| CN | 109697318 | A | 4/2019 |
| CN | 110656937 | A | 1/2020 |
| CN | 111119982 | A | 5/2020 |
| CN | 111173554 | A | 5/2020 |
| CN | 111520156 | A | 8/2020 |
| CN | 113338801 | A | 9/2021 |
| CN | 113338802 | A | 9/2021 |
| CN | 113338932 | A | 9/2021 |
| CN | 115638018 | A | 1/2023 |
| CN | 115929295 | A | 4/2023 |
| CN | 117108283 | A | 11/2023 |
| RU | 2282030 | C1 | 8/2006 |
| SU | 1645553 | A1 * | 4/1991 |

OTHER PUBLICATIONS

Xie Heping, et al., "Theories and technologies for in-situ fluidized mining of deep underground," Journal of China Coal Society, date of issue: May 15, 2018, vol. 43, No. 05, pp. 1210-1219. DOI: 10.13225/j.cnki.jccs.2018.0519 Full text. Claims involved: 1-10.

First Office Action for China Application No. 202311152056.4, mailed Jan. 22, 2024.

Notification to Grant Patent for China Application No. 202311152056.4, mailed Feb. 28, 2024.

First Search Report for China Application No. 202311152056.4, dated Jan. 18, 2024.

Supplementary Search Report for China Application No. 202311152056.4, dated Feb. 23, 2024.

International Search Report for PCT/CN2024/107587, mailed Sep. 23, 2024.

* cited by examiner

FLUIDIZED COAL MINING METHOD UTILIZING SELF-ENERGY STORAGE OF COAL SEAM

CROSS-REFERENCE TO RELATED APPLICATIONS

This application is a continuation of PCT/CN2024/107587, filed Jul. 25, 2024 and claims priority to Chinese Patent Application No. 202311152056.4, filed on Sep. 6, 2023, the contents of which are hereby incorporated by reference.

TECHNICAL FIELD

The present disclosure belongs to the technical field of coal mining, and in particular relates to a fluidized coal mining method utilizing self-energy storage of a coal seam.

BACKGROUND

For a long time to come, coal will still be the most important basic energy and industrial raw material in China, and coal will play an irreplaceable role in economic and social development. At present, more than 90% of coal mines in China adopt the method of underground mining except a small amount of open-pit mining, that is, coal is mined by arranging coal mining roadways underground and transported to the ground through the transportation system. On the one hand, this traditional underground mining method needs to construct a large number of coal mining roadways and supporting production rooms underground, which has huge geotechnical engineering quantity and high coal mining cost. On the other hand, although mechanized coal mining has been realized at present, a large number of operators are still needed in underground equipment installation, equipment operation and other operations. Once coal and gas outburst accidents occur, a large number of casualties will be caused, so the safety of underground mining is not high.

Coal and gas outburst (abbreviated as outburst) is a violent dynamic process in which the gas-bearing coal rock in underground coal mine moves rapidly from the coal seam to the mining space in a crushed state, accompanied by a large amount of gas gushing out, seriously threatening the safe production of coal mine. In recent years, research has focused on how to prevent outburst accidents. However, due to the release of a large amount of energy during the outburst process, if a large amount of energy such as gas pressure energy, coal potential energy and crustal stress stored in the coal seam is released instantly and acts on the coal itself through manual active coal uncovering, the coal body will be broken in a very short time. If this dynamic disaster is fully utilized as an effective way to break the coal body, a large amount of coal mining work will be saved.

Physical fluidized coal mining refers to the mining technology that uses hydraulic power to complete all or part of the production links of mine production, such as coal mining, transportation, lifting, etc. Physical fluidized coal mining may greatly reduce the allocation of underground roadways and underground operators, and the coal mining cost is low and the coal mining safety is high. Physical fluidized coal mining is usually applied in unstable coal seams, steep coal seams, re-mining coal seams and zones or blocks with irregular coal seams. As long as the coal seam conditions are suitable, physical fluidized coal mining may be fully utilized.

By consulting the existing related research literature, it is known that the published patents and literature have done some research on fluidized coal mining technology. Chinese Patent Application No. 202110758090.0 discloses a fluidized hydraulic coal mining method with directional drilling on ground. This method is based on directional drilling technology. Directional coal-mining drilling well is set up from the ground at a relatively high position relative to the coal seam, while directional coal suction drilling is set up from the ground facing the coal seam. Then, hydraulic cutting of the coal seam is carried out through an integrated drilling and mining device, which may reduce the coal mining cost on the premise of realizing underground operation without operators. However, the whole coal mining process depends on hydraulic power and the integrated drilling and mining device, and there is no mention of the recycling of water and gangue resources, nor the separation and treatment of the mined coal-rock mixture.

Therefore, in order to further realize fluidized coal mining with low cost and high efficiency, it is urgent to put forward a fluidized coal mining method utilizing self-energy storage of a coal seam.

SUMMARY

An objective of the present disclosure is to provide a fluidized coal mining method utilizing self-energy storage of a coal seam to solve the above problems.

To achieve the above objective, the present disclosure provides a following solution.

The fluidized coal mining method utilizing self-energy storage of a coal seam, including following steps:

- developing a mine roadway: detecting and determining a buried depth, a size and a dip angle of the coal seam to be mined, delineating different mining zones and a mining sequence; and drilling the coal seam through a well drilling system to form a lifting shaft; developing a roadway system along a bottom of the lifting shaft, and installing a ground equipment system on a ground, and the roadway system is arranged below the coal seam;
- uncovering coal actively: sending an explosive to the roadway system through the lifting shaft, sealing a top of the lifting shaft, detonating the explosive to disturb the coal seam so as to trigger a dynamic phenomenon of coal and gas outburst, and treating a fluid mixture formed by explosion through the ground equipment system;
- mining coal in fluidization: according to a position of an outburst hole formed after the uncovering coal actively, determining a position of a coal-mining drilling well on the ground, and drilling the coal-mining drilling well to an upper part of the roadway system through the well drilling system and then stopping, forming a mining zone; and mining the mining zone;
- backfilling a goaf: after a first mining zone is mined, forming the goaf, and backfilling the goaf by the ground equipment system to enable the goaf and the roadway system to form a gangue backfill zone; and
- after the backfilling is completed, repeating the above steps, and mining a next adjacent coal mining zone in turn until a mining of a whole coal seam is completed.

In some embodiments, in the step of mining the coal seam, the ground equipment system includes a gas filtering and compressing device, a gas storage tank, a settling pond, a mixture separation device, a gangue storage chamber, a water storage tank, a high-pressure pump and a coal storage bunker;

the gas filtering and compressing device is hermetically connected to a gas drainage hole opened at the top of the lifting shaft; the gas filtering and compressing device is hermetically connected to the gas storage tank through a gas conveying pipeline; and one end of the mixture separation device is connected to the settling pond opened on the ground through a conveying pipeline, and another end is in communication with the gangue storage chamber, the water storage tank and the coal storage bunker through valves respectively, and the water storage tank is hermetically connected to the high-pressure pump through a water delivery pipeline.

In some embodiments, in the step of mining the coal seam, the well drilling system includes a coal-rock mixture conveying pipe arranged in the lifting shaft; a bottom end of the coal-rock mixture conveying pipe is provided with a slurry suction pump and a crushing and stirring device, and a top end is connected to the settling pond; and the top of the lifting shaft is sealed by a wellhead sealing unit.

In some embodiments, in the step of mining coal in fluidization, the well drilling system also includes a coal-mining drilling pipe arranged in the coal-mining drilling well; an inner cavity of the coal-mining drilling pipe is hermetically connected to an output end of a high-pressure water pipe, and an input end of the high-pressure water pipe is in communication with the high-pressure pump;

a bottom end of the coal-mining drilling pipe is in transmission connection with a coal mining drill, and a bottom of the coal-mining drilling pipe is also provided with a rotation control device, and a high-pressure ejector is fixedly installed on the rotation control device through an injection distance telescopic rod, and a hollow water passage is opened in the injection distance telescopic rod, and the hollow water passage is in communication with the inner cavity of the coal-mining drilling pipe.

In some embodiments, the roadway system includes a coal-rock collection chamber and a floor roadway; a bottom end of the lifting shaft is in communication with the coal-rock collection chamber; the floor roadway is excavated along the coal-rock collection chamber, and the floor roadway is connected to the coal seam through a cross-cut.

In some embodiments, in the step of uncovering coal actively, specific steps are: sending the explosive to the cross-cut at a bottom of the coal seam through the lifting shaft, and sealing the top of the lifting shaft through a wellhead sealing unit, detonating the explosive to disturb the coal seam, where the fluid mixture formed by the explosion enters the coal-rock collection chamber through the floor roadway and then is stored in the gas storage tank through the gas drainage hole.

In some embodiments, in the step of mining coal in fluidization, the drilling the coal-mining drilling well to the upper part of the roadway system through the well drilling system specifically includes: arranging the high-pressure pump and the water storage tank at a wellhead of the coal-mining drilling well, extending the coal-mining drilling pipe into the coal-mining drilling well, and developing the coal-mining drilling well through the coal mining drill; and after the coal-mining drilling well is drilled, continuing to drill a coal seam drilling section towards the coal seam until reaching an upper part of a cross-cut, and stopping drilling.

In some embodiments, in the step of mining coal in fluidization, the forming the mining zone specifically includes: performing hydraulic cutting to a loose coal seam around the outburst hole through the high-pressure ejector, and controlling the coal-mining drilling pipe to slowly retreat until the high-pressure ejector retreats to a top end of the coal seam drilling section to complete preliminary mining; and controlling lowering and resetting of the coal-mining drilling pipe to enable the high-pressure ejector to reach a lower limit position of the buried depth of the coal seam, extending the injection distance telescopic rod to increase an effective injection distance of the high-pressure ejector and increase a water pressure, so as to enlarge a hydraulic coal breaking radius, and repeating cyclically until the first mining zone is mined.

In some embodiments, in the step of mining coal in fluidization, the mining the mining zone includes: sending a coal-rock mixture, cut in the mining zone, into the coal-rock collection chamber along the floor roadway, and lifting into the settling pond by the slurry suction pump and the crushing and stirring device.

In some embodiments, the backfilling the goaf includes: constructing a plugging unit in the floor roadway neighbouring a bottom of the coal seam adjacent to the goaf, and transporting gangue in the gangue storage chamber to the goaf for backfilling through the gangue conveying pipe, enabling the goaf and the floor roadway neighbouring the bottom to form the gangue backfill zone; and after the backfilling is completed, repeating the above steps, and mining the next adjacent mining zone in turn until the mining of the coal seam is completed, and backfilling the coal-rock collection chamber and the lifting shaft.

Compared with the prior art, the present disclosure has following advantages and technical effects. The present disclosure provides the fluidized coal mining method utilizing self-energy storage of a coal seam, and before the traditional physical fluidized coal mining, the coal body at a predetermined position is actively and controllably uncovered to induce a dynamic phenomenon, and a large amount of energy such as gas expansion energy and crustal stress energy stored in the coal seam itself acts on the coal body itself, not only effectively controlling the coal and gas outburst disaster, but also realizing the initial high crushing of the coal body, and truly realizing turning waste into treasure. Moreover, the coal body around the hole may be loosened, which saves a lot of workloads for subsequent hydraulic coal mining and improves the overall coal mining efficiency.

During coal mining, the gas released by coal seams and coal particles is collected synchronously, and meanwhile, coal, water and gangue are separated from the coal-rock mixture lifted up to the well by the separation device. The separated water is returned to the water storage tank for recycling in fluidized coal mining, and the gangue is used for backfilling the goaf, so that the resources in the coal mining process are fully utilized, which not only effectively saves the production cost, but also realizes the green and efficient co-mining of coal and gas.

A complete process of fluidized coal mining by utilizing the self-energy storage capacity of the coal seam is formulated, the mining zone and mining sequence are optimized based on the actual conditions of coal seam. Moreover, the injection range of high-pressure ejector may be changed by adding the telescopic rod with injection distance on the fixed drilling rod, which increases the dimension of single mining zone, greatly improves the coal mining efficiency and reduces the engineering quantity of drilling construction. At the same time, through the cyclical backfilling of the goaf and floor roadway, there is no need to leave coal pillars. Combined with the rotation control device and the injection distance telescopic rod, the corner coal and residual coal may be effectively crushed. Compared with traditional coal mining methods, the coal recovery rate may be increased by about 20%, and 100% coal recovery is basically realized, effectively avoiding the waste of coal resources.

BRIEF DESCRIPTION OF THE DRAWINGS

In order to explain the embodiments of the present disclosure or the technical solution in the prior art more clearly, the drawings needed in the embodiments will be briefly introduced below. Apparently, the drawings in the following description are only some embodiments of the disclosure, and other drawings may be obtained by one of ordinary skill in the art without creative effort.

DETAILED DESCRIPTION OF THE EMBODIMENTS

The technical solutions in the embodiment of the present disclosure will be described clearly and completely with reference to the attached drawings. Apparently, the described embodiments are only a part of the embodiments of the present disclosure, but not all the embodiments. Based on the embodiments in the present disclosure, all other embodiments obtained by one of ordinary skill in the art without creative effort belong to the protection scope of the present disclosure.

In order to make the above objectives, features and advantages of the present disclosure clearer and easier to understand, the present disclosure will be further described in detail with the attached drawings and specific embodiments.

Figure 1:
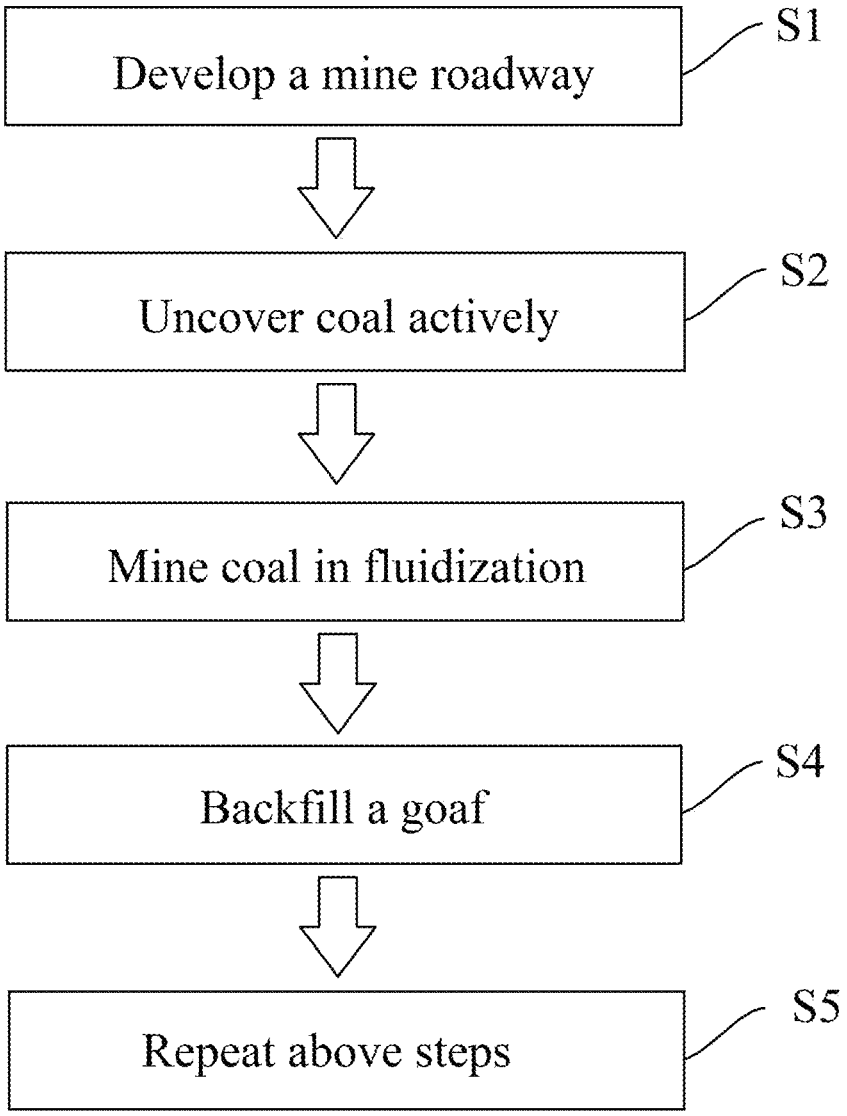
FIG. 1 is a flow chart of a fluidized coal mining method utilizing self-energy storage of a coal seam.

A fluidized coal mining method utilizing self-energy storage of a coal seam is provided, as shown in FIG. 1, includes following steps.

A mine roadway is developed: a buried depth, a size and a dip angle of the coal seam 1 to be mined are detected and determined, and different mining zones and a mining sequence are delineated; and the coal seam 1 is drilled through a well drilling system to form a lifting shaft 2; a roadway system is developed along a bottom of the lifting shaft 2, and a ground equipment system is installed on a ground, the roadway system is arranged below the coal seam 1.

Coal is uncovered actively: an explosive is sent to the roadway system through the lifting shaft 2, a top of the lifting shaft 2 is sealed, the explosive is detonated to disturb the coal seam 1 so as to trigger a dynamic phenomenon of coal and gas outburst, and a fluid mixture formed by explosion is treated through the ground equipment system.

Fluidized coal mining: according to a position of an outburst hole 6 formed after the coal is uncovered actively, a position of a coal-mining drilling well is determined 12 on the ground, and the coal-mining drilling well 12 is drilled to an upper part of the roadway system through the well drilling system and then is stopped, a mining zone is formed; and the mining zone is mined.

A goaf is backfilled: after a first mining zone is mined, the goaf 31 is formed, and the goaf 31 is backfilled through the ground equipment system to enable the goaf 31 and the roadway system to form a gangue backfill zone 32.

After the backfilling is completed, the above steps are repeated, and a next adjacent coal mining zone is mined in turn until the whole coal seam 1 is mined.

In the step of coal seam mining, the ground equipment system includes a gas filtering and compressing device 9, a gas storage tank 10, a settling pond 20, a mixture separation device 21, a gangue storage chamber 22, a water storage tank 23, a high-pressure pump 24 and a coal storage bunker 25.

The gas filtering and compressing device 9 is hermetically connected to a gas drainage hole 8 opened at the top of the lifting shaft 2; the gas filtering and compressing device 9 is hermetically connected to the gas storage tank 10 through a gas conveying pipeline.

One end of the mixture separation device 21 is connected to the settling pond 20 opened on the ground through a conveying pipeline, and the other end is in communication with the gangue storage chamber 22, the water storage tank 23 and the coal storage bunker 25 through valves respectively, and the water storage tank 23 is hermetically connected to the high-pressure pump 24 through a water delivery pipeline.

In the step of coal seam mining, the well drilling system includes a coal-rock mixture conveying pipe 28 arranged in the lifting shaft 2; a bottom end of the coal-rock mixture conveying pipe 28 is provided with a slurry suction pump 26 and a crushing and stirring device 27, and a top end is connected to the settling pond 20.

The top of the lifting shaft 2 is sealed by a wellhead sealing unit 11.

In the step of fluidized coal mining, the well drilling system also includes a coal-mining drilling pipe 13 arranged in the coal-mining drilling well 12; an inner cavity of the coal-mining drilling pipe 13 is hermetically connected to an output end of a high-pressure water pipe 14, and an input end of the high-pressure water pipe 14 is in communication with the high-pressure pump 24.

A bottom end of the coal-mining drilling pipe 13 is in transmission connection with a coal mining drill 15, and a bottom of the coal-mining drilling pipe 13 is also provided with a rotation control device 16, and a high-pressure ejector is fixedly installed on the rotation control device 16 through an injection distance telescopic rod 18, and a hollow water passage is opened in the injection distance telescopic rod 18, and the hollow water passage is in communication with the inner cavity of the coal-mining drilling pipe 13.

The roadway system includes a coal-rock collection chamber 3 and a floor roadway 4; a bottom end of the lifting shaft 2 is in communication with the coal-rock collection chamber 3; the floor roadway 4 is excavated along the coal-rock collection chamber 3, and the floor roadway 4 is connected to the coal seam through a cross-cut 5.

Figure 2:
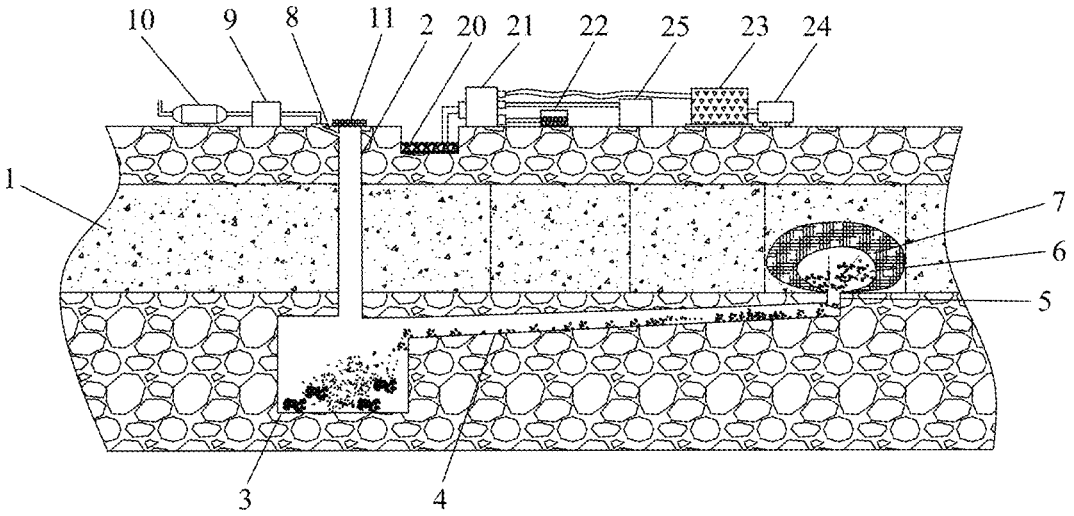
FIG. 2 is a schematic diagram of active coal uncovering of the fluidized coal mining method utilizing self-energy storage of a coal seam.

In the step of uncovering coal actively, specific steps are: the explosive is sent to the cross-cut 5 at a bottom of the coal seam 1 through the lifting shaft 2, and the top of the lifting shaft 2 is sealed through a wellhead sealing unit 11, the explosive is detonated to disturb the coal seam 1. The fluid mixture formed by the explosion enters the coal-rock collection chamber 3 through the floor roadway 4 and then is stored in the gas storage tank 10 through the gas drainage hole 8, as shown in FIG. 2.

Figure 3:
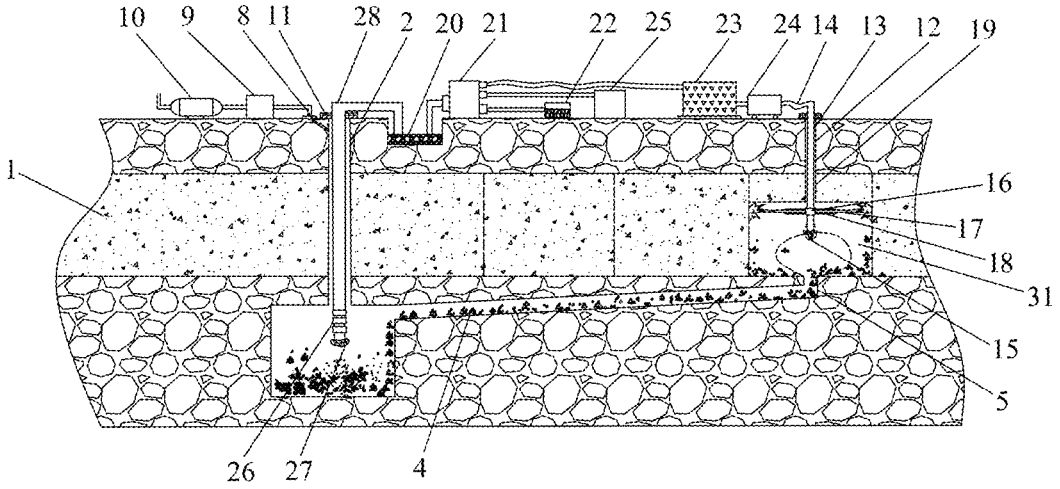
FIG. 3 is a schematic diagram of fluidized mining of the fluidized coal mining method utilizing self-energy storage of a coal seam.

As shown in FIG. 3, in the step of fluidized coal mining, the coal-mining drilling well 12 is drilled to the upper part of the roadway system through the well drilling system specifically includes: the high-pressure pump 24 and the water storage tank 23 are arranged at a wellhead of the coal-mining drilling well 12, the coal-mining drilling pipe 13 is extended into the coal-mining drilling well 12, and the coal-mining drilling well 12 is developed through the coal mining drill 15; and after the coal-mining drilling well 12 is drilled, continuing to drill a coal seam drilling section 19 towards the coal seam 1 until reaching an upper part of the cross-cut 5, and the drilling is stopped.

In the step of fluidized coal mining, the mining zone is formed specifically includes: hydraulic cutting is performed to a loose coal seam around the outburst hole 6 by the high-pressure ejector 17, and the coal-mining drilling pipe 13 is controlled to slowly retreat until the high-pressure ejector 17 retreats to a top end of the coal seam drilling section 19 to complete preliminary mining.

Lowering and resetting of the coal-mining drilling pipe 13 are controlled to enable the high-pressure ejector 17 to reach a lower limit position of the buried depth of the coal seam, the injection distance telescopic rod 18 is extended to increase an effective injection distance of the high-pressure ejector 17 and a water pressure is increased, so as to enlarge a hydraulic coal breaking radius, and the above steps are repeated cyclically until the first mining zone is mined.

In the step of fluidized coal mining, the mining zone is mined includes: after being cut in the mining zone, the coal-rock mixture is sent into the coal-rock collection chamber 3 along the floor roadway 4, and lifted into the settling pond 20 by the slurry suction pump 26 and the crushing and stirring device 27.

Figure 4:
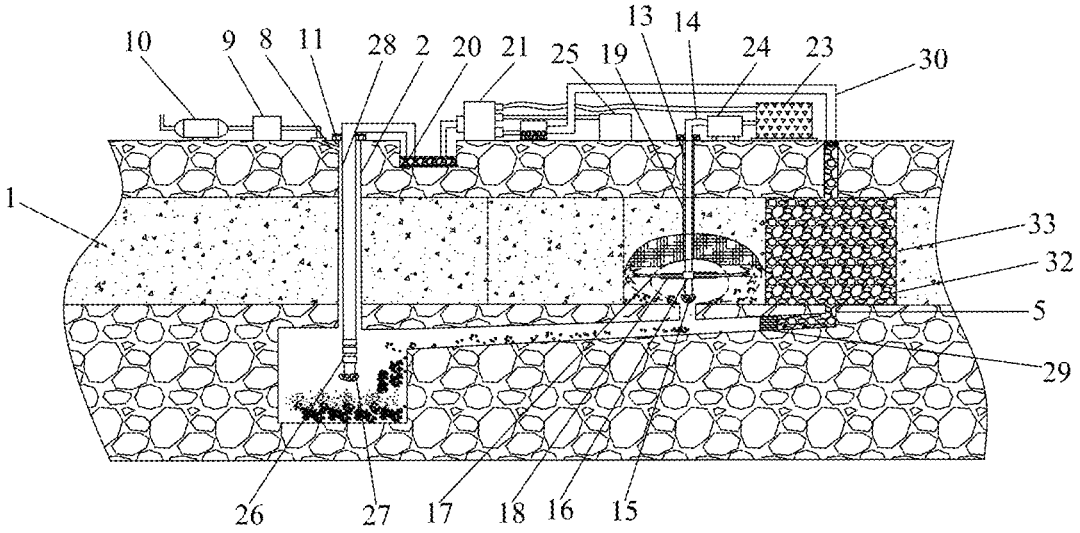
FIG. 4 is a schematic diagram of goaf backfilling and adjacent section mining of the fluidized coal mining method utilizing self-energy storage of a coal seam.

As shown in FIG. 4, the goaf is backfilled includes: a plugging unit 29 is constructed in the floor roadway 4 neighbouring a bottom of the adjacent coal seam 1 adjacent to the goaf 31, and the gangue in the gangue storage chamber 22 is transported to the goaf 31 for backfilling through the gangue conveying pipe 30, so that the goaf 31 and a part, neighbouring the bottom of the goaf 31, of the floor roadway 4 form the gangue backfill zone 32.

After the backfilling is completed, the above steps are repeated, and a next adjacent mining zone is mined in turn until the mining of the coal seam 1 is completed, and the coal-rock collection chamber 3 and the lifting shaft 2 are backfilled.

In one embodiment of the disclosure, in the step of uncovering coal actively, the explosive is detonated to disturb the coal seam 1 to trigger a dynamic phenomena such as coal and gas outburst, so that a large amount of gas expansion energy, crustal stress energy and gravitational potential energy stored in the coal seam 1 are instantly released and act on the coal seam 1 itself to achieve the purpose of highly crushing the coal seam 1, thereby completing the active coal uncovering and forming a fluid mixture of coal, rock, gas and water. The initial high crushing of the coal is realized, and the coal of the coal loosen zone 7 around the outburst hole is loosened, thereby improving the efficiency of subsequent fluidized coal mining and hydraulic coal mining.

In one embodiment of the present disclosure, the floor roadway 4 and the coal seam 1 both have a dip angle of 5°, ensuring that the coal-rock mixture with outburst and hydraulic coal breaking may be automatically transported to the coal-rock collection chamber 3 under the conditions of doing work through continuous expansion of gas and work through self-gravity so as to avoid the blockage of the floor roadway 4.

Further, the coal-mining drilling well 12 is used to drill the outburst hole 6, and the coal seam 1 around the outburst hole 6 is subjected to in-situ hydraulic cutting. The coal-rock mixture subjected to hydraulic cutting flows into the coal-rock collection chamber 3 along the floor roadway 4, and is lifted up to the well by the slurry suction pump 26 to enter the settling pond 20, thus realizing efficient fluidized coal mining.

In one embodiment of the present disclosure, gas is extracted synchronously during coal mining. Meanwhile, the coal-rock mixture lifted up to the well by the slurry suction pump 26 enters into the settling pond 20, and is separated into coal, water and gangue by the mixture separation device 21. The coal is transported to the coal storage bunker 25, and the water is sent to the water storage tank 23 via water pipe for recycling. The gas released from the coal seam and broken coal particles during coal mining enters the gas filtering and compressing device 9 through the gas drainage hole 8, purified and stored in the gas storage tank 10, the separated water is returned to the water storage tank 23 for recycling in fluidized coal mining. And the gangue is used for backfilling the goaf 31 and the floor roadway 4, realizing the full utilization of resources in the coal mining process.

In one embodiment of the present disclosure, by extending the injection distance telescopic rod 18, the injection range of the high-pressure injector 17 may be effectively increased, and the dimension of the single mining zone is increased, so as to reduce the drilling construction project and improve the coal mining efficiency.

In one embodiment of the present disclosure, the mining zone is defined in advance according to the coal seam condition, and the goaf 31 and floor roadway 4 of the previous block are backfilled before mining this block to prevent the roof from collapsing in the subsequent mining, so there is no need to leave coal pillars in the subsequent mining process, which effectively improves the recovery rate of coal resources.

In one embodiment of the present disclosure, backfill is carried out in the mining zone adjacent to the goaf and the mining zone boundary 33 formed by the goaf; the mining zones adjacent to the goaf are mined in turn, and extend along the floor roadway 4. The cross-cut 5 is formed at the bottom of the remaining mining zone. The floor roadway 4 at the bottom of the goaf and the cross-cuts 5 at the bottoms of remaining mining zones are cut off by the constructing the plugging unit.

In the description of the present disclosure, it should be understood that the terms "longitudinal", "transverse", "up", "down", "front", "back", "left", "right", "vertical", "horizontal", "top", "bottom", "inside", "outside", etc. indicate orientation or positional relationships based on the orientation or positional relationships shown in the accompanying drawings, only for the convenience of describing the present disclosure, and do not indicate or imply that the device or element referred to must have a specific orientation, be constructed and operated in a specific orientation, and therefore should not be understood as limiting the disclosure.

The above-mentioned embodiments only describe the preferred mode of the present disclosure, and do not limit the scope of the present disclosure. Under the premise of not departing from the design spirit of the present disclosure, various modifications and improvements made by one of ordinary skill in the art to the technical solution of the present disclosure shall fall within the protection scope determined by the claims of the present disclosure.

What is claimed is:

1. A fluidized coal mining method utilizing self-energy storage of a coal seam, comprising following steps:

developing a mine roadway: detecting and determining a buried depth, a size and a dip angle of the coal seam to be mined, delineating different mining zones and a mining sequence; and drilling the coal seam through a well drilling system to form a lifting shaft; developing a roadway system along a bottom of the lifting shaft, and installing a ground equipment system on a ground; and wherein the roadway system is arranged below the coal seam;

uncovering coal actively: sending an explosive to the roadway system through the lifting shaft, sealing a top of the lifting shaft, detonating the explosive to disturb the coal seam so as to trigger a dynamic phenomenon of coal and gas outburst, and treating a fluid mixture formed by explosion through the ground equipment system;

mining coal in fluidization: according to a position of an outburst hole formed after the uncovering coal actively, determining a position of a coal-mining drilling well on the ground, drilling the coal-mining drilling well to an upper part of the roadway system through the well drilling system and stopping, forming a mining zone; and mining the mining zone;

backfilling a goaf: after a first mining zone is mined, forming the goaf, and backfilling the goaf by the ground equipment system to enable the goaf and the roadway system to form a gangue backfill zone; and after the backfilling is completed, repeating above steps, and mining a next adjacent coal mining zone in turn until a mining of a whole coal seam is completed.

2. The fluidized coal mining method utilizing the self-energy storage of the coal seam according to claim 1, wherein in the step of mining the coal seam, the ground equipment system comprises a gas filtering and compressing device, a gas storage tank, a settling pond, a mixture separation device, a gangue storage chamber, a water storage tank, a high-pressure pump and a coal storage bunker;

the gas filtering and compressing device is hermetically connected to a gas drainage hole opened at the top of the lifting shaft; and the gas filtering and compressing device is hermetically connected to the gas storage tank through a gas conveying pipeline; and one end of the mixture separation device is connected to the settling pond opened on the ground through a conveying pipeline, and an other end is in communication with the gangue storage chamber, the water storage tank and the coal storage bunker through valves respectively, and the water storage tank is hermetically connected to the high-pressure pump through a water delivery pipeline.

3. The fluidized coal mining method utilizing the self-energy storage of the coal seam according to claim 2, wherein in the step of mining the coal seam, the well drilling system comprises a coal-rock mixture conveying pipe arranged in the lifting shaft; a bottom end of the coal-rock mixture conveying pipe is provided with a slurry suction pump and a crushing and stirring device, and a top end is connected to the settling pond; and the top of the lifting shaft is sealed by a wellhead sealing unit.

4. The fluidized coal mining method utilizing the self-energy storage of the coal seam according to claim 3, wherein in the step of mining coal in fluidization, the mining the mining zone comprises: sending a coal-rock mixture, cut in the mining zone, into a coal-rock collection chamber along the floor roadway, and lifting into the settling pond through the slurry suction pump and the crushing and stirring device.

5. The fluidized coal mining method utilizing the self-energy storage of the coal seam according to claim 2, wherein in the step of mining coal in fluidization, the well drilling system also comprises a coal-mining drilling pipe arranged in the coal-mining drilling well; an inner cavity of the coal-mining drilling pipe is hermetically connected to an output end of a high-pressure water pipe, and an input end of the high-pressure water pipe is in communication with the high-pressure pump; and a bottom end of the coal-mining drilling pipe is in transmission connection with a coal mining drill, and a bottom of the coal-mining drilling pipe is also provided with a rotation control device, a high-pressure ejector is fixedly installed on the rotation control device through an injection distance telescopic rod, and a hollow water passage is opened in the injection distance telescopic rod, and the hollow water passage is in communication with the inner cavity of the coal-mining drilling pipe.

6. The fluidized coal mining method utilizing the self-energy storage of the coal seam according to claim 5, wherein in the step of mining coal in fluidization, the drilling the coal-mining drilling well to the upper part of the roadway system through the well drilling system specifically comprises: arranging the high-pressure pump and the water storage tank at a wellhead of the coal-mining drilling well, extending the coal-mining drilling pipe into the coal-mining drilling well, and developing the coal-mining drilling well through the coal mining drill; and after the coal-mining drilling well is drilled, continuing to drill a coal seam drilling section towards the coal seam until reaching an upper part of a cross-cut, and stopping drilling.

7. The fluidized coal mining method utilizing the self-energy storage of the coal seam according to claim 6, wherein in the step of mining coal in fluidization, the forming the mining zone specifically comprises: performing hydraulic cutting to a loose coal seam around the outburst hole through the high-pressure ejector, and controlling the coal-mining drilling pipe to slowly retreat until the high-pressure ejector retreats to a top end of the coal seam drilling section to complete preliminary mining; and controlling lowering and resetting of the coal-mining drilling pipe to enable the high-pressure ejector to reach a lower limit position of the buried depth of the coal seam; extending the injection distance telescopic rod to increase an effective injection distance of the high-pressure ejector and increasing a water pressure, so as to enlarge a hydraulic coal breaking radius; and repeating cyclically until the first mining zone is mined.

8. The fluidized coal mining method utilizing the self-energy storage of the coal seam according to claim 2, wherein the roadway system comprises a coal-rock collection chamber and a floor roadway; a bottom end of the lifting shaft is in communication with the coal-rock collection chamber; and the floor roadway is excavated along the coal-rock collection chamber, and the floor roadway is connected to the coal seam through a cross-cut.

9. The fluidized coal mining method utilizing the self-energy storage of the coal seam according to claim 5, wherein in the step of uncovering coal actively, specific steps are: sending the explosive to the cross-cut at a bottom of the coal seam through the lifting shaft, and sealing the top of the lifting shaft through a wellhead sealing unit, detonating the explosive to disturb the coal seam, wherein the fluid mixture formed by the explosion enters the coal-rock collection chamber through the floor roadway and then is stored in the gas storage tank through the gas drainage hole.

10. The fluidized coal mining method utilizing the self-energy storage of the coal seam according to claim 8, wherein in the step of mining coal in fluidization, the backfilling the goaf comprises: constructing a plugging unit in the floor roadway neighbouring a bottom of the coal seam adjacent to the goaf, and transporting gangue in the gangue storage chamber to the goaf for backfilling through the gangue conveying pipe, enabling the goaf and the floor roadway neighbouring the bottom to form the gangue backfill zone; and after the backfilling is completed, repeating above steps, and mining the next adjacent mining zone in turn until the mining of the coal seam is completed, and backfilling the coal-rock collection chamber and the lifting shaft.

* * * * *